United States Patent [19]

VanderLugt, Jr.

[11] 4,215,783

[45] Aug. 5, 1980

[54] CARTON WITH RECLOSURE FEATURE

[75] Inventor: Thomas VanderLugt, Jr., Kalamazoo, Mich.

[73] Assignee: Brown Company, Kalamazoo, Mich.

[21] Appl. No.: 49,952

[22] Filed: Jun. 18, 1979

[51] Int. Cl.[2] ..... B65D 17/24

[52] U.S. Cl. ..... 206/626; 229/45 R

[58] Field of Search ..... 206/621, 624, 625, 626, 206/622; 229/45 R

[56] References Cited

U.S. PATENT DOCUMENTS

| | | | |
|---|---|---|---|
| Re. 26,471 | 10/1968 | Meyers . | |
| 3,191,848 | 6/1965 | Meyers . | |
| 3,294,309 | 12/1966 | Coe | 229/45 R |
| 3,378,188 | 4/1968 | Meyers . | |
| 3,595,466 | 7/1971 | Rosenburg, Jr. | 206/626 X |
| 3,606,133 | 9/1971 | Meyers | 206/622 |
| 3,608,812 | 9/1971 | Hamilton | 229/45 |
| 3,680,767 | 8/1972 | De Lorenzo et al. | 229/45 |
| 3,724,741 | 4/1973 | Jacobson | 206/622 |
| 3,893,614 | 7/1975 | Meyers | 206/626 |

*Primary Examiner*—Stephen P. Garbe

*Attorney, Agent, or Firm*—Gordon W. Hueschen

[57] ABSTRACT

A carton having structure for locking the cover thereof in place after the seal has been broken, carton blanks for the production thereof, and an end closure for such a carton are disclosed. The lock structure comprises two elements, the first a centrally-located lock flap articulated along its one edge to the upper edge of the carton front face panel and separated by a cut from the second lock flap, which is secured on the inner surface of the cover front panel, said second lock flap comprising two surrounding webs which are, in the carton blank and in the originally sealed carton, attached along lines of severance to the upper edge of the carton front face panel and which become detached along said severance lines during opening of the originally sealed carton. The second lock flap peripherally or circumferentially substantially abuts the free edges of the first lock flap along all of the free edges thereof, thereby enabling rapid and positive relocking of the carton upon reclosure after the original package has been opened. The carton is characterized by numerous advantages over prior art constructions due to the novel lock structure, in which the respective lock flaps or elements are always in substantially abutting mutual engagement along all of the free edges of the lock flap appended to the upper edge of the carton front face panel, and does not depend upon mutual engagement along ruptured perforation lines or precise squaring of the carton during its erection for positive effectiveness of the lock structure, and moreover is characterized by economic advantage in that the lock structure minimizes the amount of paperboard which must be employed in constructing the carton including the lock structure thereof from an integral blank.

6 Claims, 6 Drawing Figures

CARTON WITH RECLOSURE FEATURE

BACKGROUND OF INVENTION

1. Field of Invention

Hooded cartons, cartons with means for locking the cover in place after the seal has once been broken, carton blanks for production thereof, and locking carton end closures.

2. Prior Art

The prior art is replete with numerous so-called "flip top" cartons having a cover hingedly connected to the top edge of the rear wall, including such cartons as provide locking means for locking the cover thereof in place after the seal has once been broken. Some representative cartons of this type are illustratively disclosed in U.S. Pat. Nos. 3,191,848, 3,378,188, 3,893,614, and Reissue 26,471. Additional cartons of this type are disclosed in U.S. Pat. Nos. 3,294,309 and 3,295,742. Although numerous carton structures of this general type have been proposed, most of them in practice leave much to be desired and suffer from various disadvantages and shortcomings.

One particular shortcoming of previous reclosable hooded lock cartons is that certain of them have depended for positive relocking upon exact squaring up of the carton during its erection, with the resultant effect that, when the carton was not perfectly square, the efficiency of the lock means was impaired considerably. Another shortcoming of previous lock carton constructions has been that the lock flaps frequently substantially abutted each other only along a single horizontal cut or perforation line, as said cut or perforation line existed in the erected and opened and then reclosed carton, so that even when the lock flaps were in substantially abutting mutual engagement with each other, the area or linear distance of said substantial abutment was less than desired. Both of these shortcomings are obviated by the present invention, in which the positive locking effect of the lock members according to the invention is not dependent upon perfect squaring of the carton upon erection and in which the one lock flap, separated from the other lock flap by a peripheral cut, actually has surrounding edges for substantial abutting mutual engagement with the first said lock flap along its entire periphery, except of course on an edge thereof which is articulated to the upper edge of the carton front wall.

Another shortcoming of prior art cartons, wherein the two lock flaps were severed from each other along a line of severance during original opening of the package, has been that, when the rupture along the line of severance has been other than precise, the abutting mutual engagement resulting upon reclosure of the carton has been less than desirable, frequently resulting in a skewed relationship between the cover and carton body upon reclosure, or even an impossibility of locking upon reclosure in the event that actual severance substantially departed from the intended line of severance between the two lock elements. This objection is essentially avoided in the lock means and cartons of the present invention, since the two lock elements are not ruptured from each other upon original opening of the package and do not depend upon abutting mutual engagement along a line of severance, much less a substantially horizontal line of severance, but rather depend for their substantially abutting mutual engagement upon the peripheral or circumferential abutting mutual engagement of the two lock elements along all of the free edges of the lock flap which is articulated to the upper edge of the carton front face panel, except of course that portion of the said lock flap which is articulated to the upper edge of the said carton front face panel.

The carton structure, and particularly the carton lock structure, of the present invention thus have a number of advantages over similar cartons and similar lock structures of the prior art. The carton is of course of the "flip-top" type and is hooded, that is, has side panels which slide over the mouth of the carton and provide an efficient and safe enclosure for the carton end. The carton is provided with lock flaps for retaining the cover in closed position, even after the main seal of the carton has been originally broken. Moreover, the lock flaps of the particular structure of the invention are so formed that their engaging edges are completely unattached to each other, thus permitting smooth complementary and surrounding engaging surfaces, as opposed to prior art compounds which utilize lock flaps which are detachably connected to each other at a severance line and which serve for retaining the cover in sealed position. The edges of such lock flaps are unfortunately jagged and irregular and hinder and even adversely affect the proper operation of the lock flap or flaps. Moreover, some of the cartons of the prior art require engagement of lock flaps attached to the upper edge of a carton front panel beneath cutaway carton side wall end flaps, similar to the glue flaps in the cover of the present invention, alone or in addition to engagement with a centrally-located complementary member on the inside surface of the cover front panel. Unfortunately, this has the further complication that the substantially abutting mutual engagement desired between the carton cover side wall end flaps and lock flaps attached to the upper edge of the carton front panel is seriously affected when these end flaps attached to the cover front panel interior surface are not in complete alignment, as often occurs when a carton is not completely squared up or a cover is not completely squared up during carton formation and sealing. Moreover, in numerous reclosable cartons of the prior art, it is necessary that cutaway or breakaway side panels be provided for adequate original closure and reclosure, and that the reclosure be effected by lock means between cover side panels and carton side panels as well as between cover front panel and carton front panel. Although such structures are indeed operative, they are undesirably complex and additionally require the employment of substantial additional quantities of paperboard for their construction, thereby seriously impairing their favorable economics. The carton of the present invention and the lock means of the present invention are relatively inexpensive to produce, simple to construct, fill, and seal, and they do not require a redesign of machinery for assembly. The cartons of the present invention have a positive lock due to the clean-cut edges of the opposing complementary lock members. A better solution to the problem of reclosable hooded cartons is long overdue, and one such better solution is provided by the carton, carton lock means, and carton end closure of the present invention.

SUMMARY AND OBJECTS OF THE INVENTION

The carton of the invention has means for locking the cover thereof in place after the seal has been broken and includes carton blanks for the production thereof and an end closure for such a carton. According to the invention, the lock means comprises two elements, the first a centrally-located lock flap articulated along its one edge to the upper edge of the carton front face panel and separated by a cut from the second lock flap, which is secured on the inner surface of the cover front panel, said second lock flap comprising two surrounding webs which are, in the carton blank and in the originally sealed carton, attached along lines of severance to the upper edge of the carton front face panel and which become detached along said severance lines during opening of the originally sealed carton. The second lock flap peripherally or circumferentially substantially abuts the free edges of the first lock flap along all of the free edges thereof, thereby enabling rapid and positive relocking of the carton upon reclosure after the original package has been opened and is characterized by numerous advantages over prior art constructions due to the novel lock means, in which the respective lock flaps or elements are always in substantially abutting mutual engagement along all of the free edges of the lock flap appended to the upper edge of the carton front face panel, and does not depend upon mutual engagement along ruptured perforation lines or precise squaring of the carton during its erection for positive effectiveness of the lock means, and moreover is characterized by economic advantage in that the lock means structure minimizes the amount of paperboard which must be employed in constructing the carton and lock means therefor from an integral blank.

It is accordingly an object of the present invention to provide improved hooded cartons having a lock of the type described, carton blanks for the production thereof, and a novel end closure for such type of carton. Another object of the invention is to provide such structures which are simple and economical to produce and which do not suffer from numerous of the disadvantages which are inherent in or attendant upon the employment of previously-available prior art structures. The accomplishment of the foregoing and additional objects will become more fully apparent hereinafter, and still other objects will be obvious to one skilled in the art to which this invention pertains.

The invention, then, in summary, may be defined as follows:

a carton formed of an integral blank comprising a container assembly including a front wall panel, a rear wall panel, and side wall panels, and a cover assembly hingedly connected to said rear wall panel including a cover top panel having a cover front wall panel and cover end wall panels connected thereto, and first and second lock flaps positioned between said cover front wall panel and said front wall panel, said first lock flap being affixed to the inner surface of said cover front wall panel and said second lock flap being hingedly connected to the upper edge of and folded over into juxtaposition with the outer surface of said front wall panel, said second lock flap being articulated to the upper edge of said front wall panel and being located centrally thereof, said first lock flap comprising a central body portion and webs outwardly disposed with respect to said second lock flap, said first lock flap surrounding said second lock flap and the said webs of said first lock flap being detachably connected by lines of severance to the upper edge of said front wall panel at their ends, the edges of said second lock flap being surrounded by and in substantially abutting mutual engagement with but free of attachment to the corresponding edges of said first lock flap on all sides of said second lock flap except the side hingedly connected to the upper edge of said front wall panel whereby, upon opening and reclosing of said carton, said lock flaps cooperate to retain said cover in closed position by substantially abutting mutual engagement of the surrounding edges of said first lock flap with the corresponding free edges of said second lock flap, as well as an integral carton blank for forming such a carton wherein the ends of said webs of said first closure flap are detachably connected to the upper edge of said front face panel by perforations, as well as such an integral carton blank, comprising a glue flap hinged along a side edge of one of said rear wall panel and a side wall panel, side seamed by having the other of said panels adhered to said glue flap, folded over upon itself in the form of a flat-folded tube, and additionally an end closure for a carton having a container portion closed at its lower end and comprising front, rear, and side wall panels, said end closure including a cover assembly hingedly connected to said rear wall panel including a cover top panel having a cover front wall panel and cover end wall panels connected thereto, and first and second lock flaps positioned between said cover front wall panel and said front wall panel, said first lock flap being affixed to the inner surface of said cover front wall panel and said second lock flap being hingedly connected to the upper edge of and folded over into juxtaposition with the outer surface of said front wall panel, said second lock flap being articulated to the upper edge of said front wall panel and being located centrally thereof, said first lock flap comprising a central body portion and webs outwardly disposed with respect to said second lock flap, said first lock flap surrounding said second lock flap and the said webs of said first lock flap being detachably connected by lines of severance to the upper edge of said front wall panel at their ends, the edges of said second lock flap being surrounded by and in substantially abutting mutual engagement with but free of attachment to the corresponding edges of said first lock flap on all sides of said second lock flap except the side hingedly connected to the upper edge of said front wall panel whereby, upon opening and reclosing of said carton, said end closure retains said cover in closed position by substantially abutting mutual engagement of the surrounding edges of said first lock flap with the corresponding edges of said second lock flap along free edges thereof.

Additional aspects of the invention exist and will become apparent as the description proceeds.

DESCRIPTION OF THE PREFERRED EMBODIMENTS OF THE INVENTION

The invention in a preferred embodiment is illustrated by the accompanying drawings in which.

Figure 1:
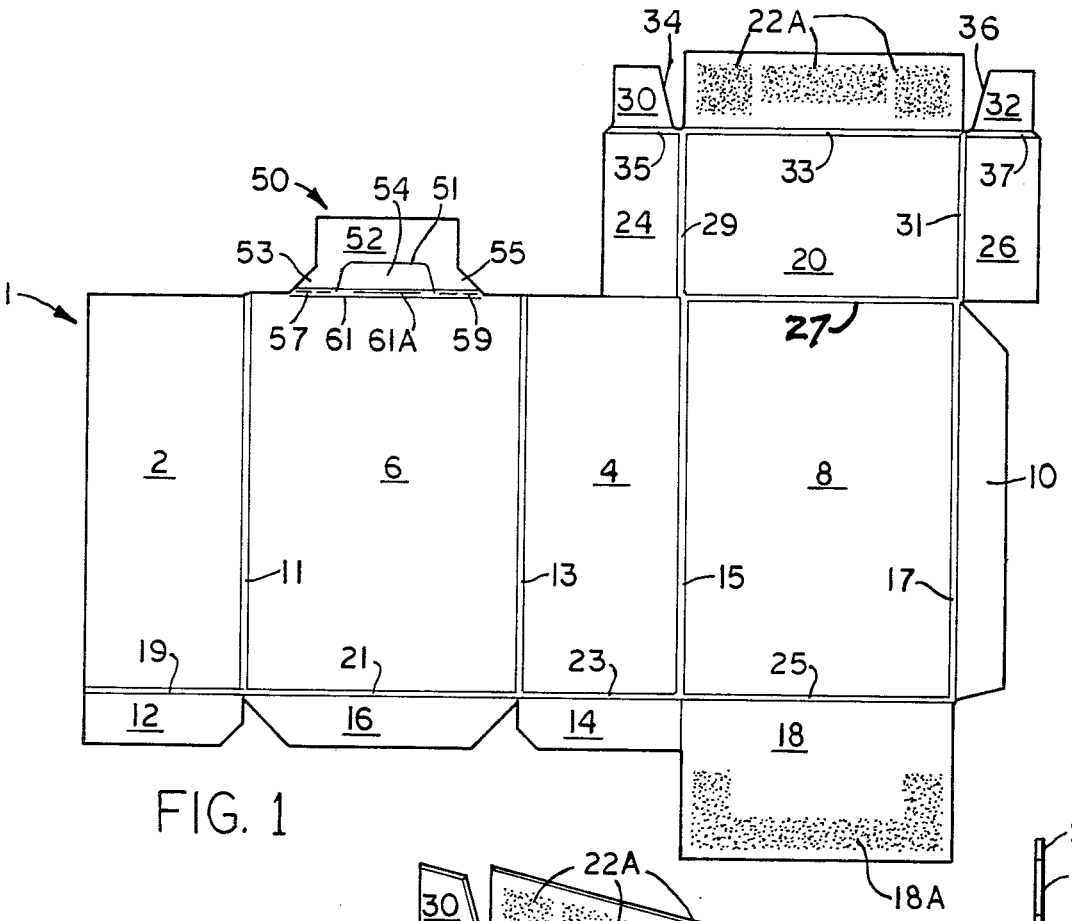
FIG. 1 is a plan view of a cut and scored blank for forming a carton having the novel lock means feature according to the invention, viewed from the inside surface thereof.
Figure 2:
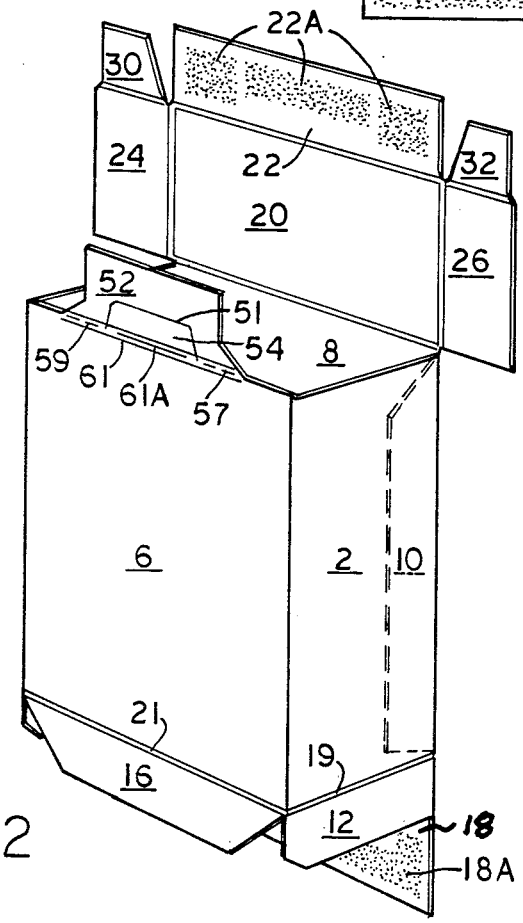
FIG. 2 is a perspective view of the blank of FIG. 1 partially glued and in the form of an erected sleeve or tube.
Figure 2A:
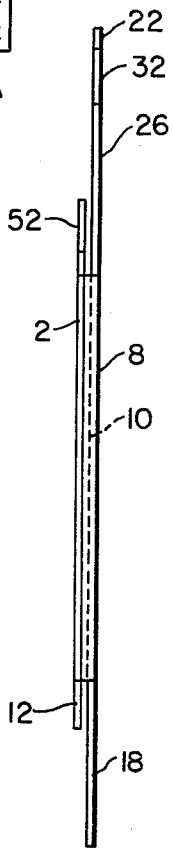

FIG. 2*a* is a side or edge view of the carton blank of FIG. 1 side-seamed by having a side wall panel adhered to its glue flap, folded-over and in the form of a flat-folded tube or sleeve, before squaring up into an open tube or sleeve as shown in FIG. 2.

Figure 3:
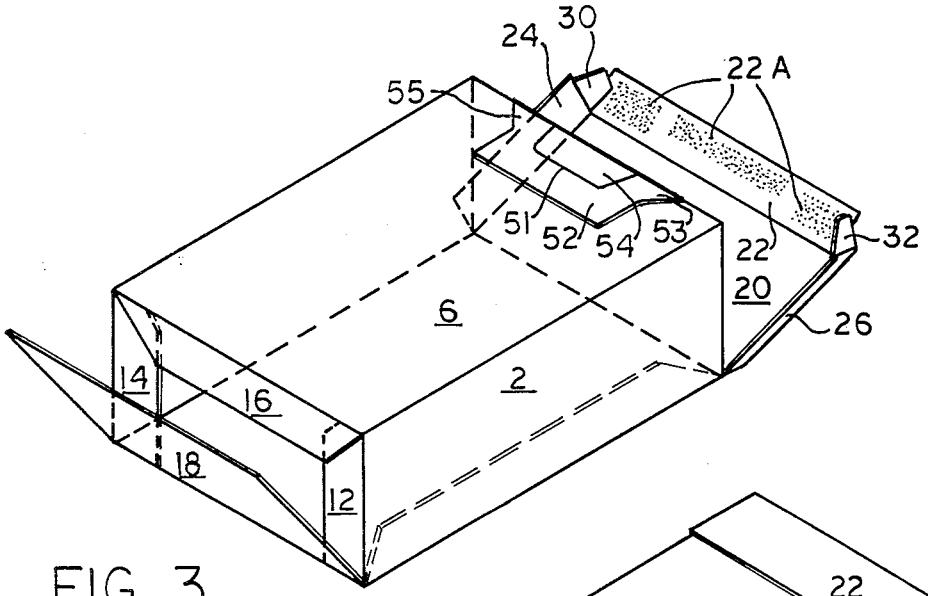

FIG. 3 is a perspective view of the sleeve of FIG. 2, with its bottom about to be closed and its hooded cover about to be erected and closed.

Figure 4:
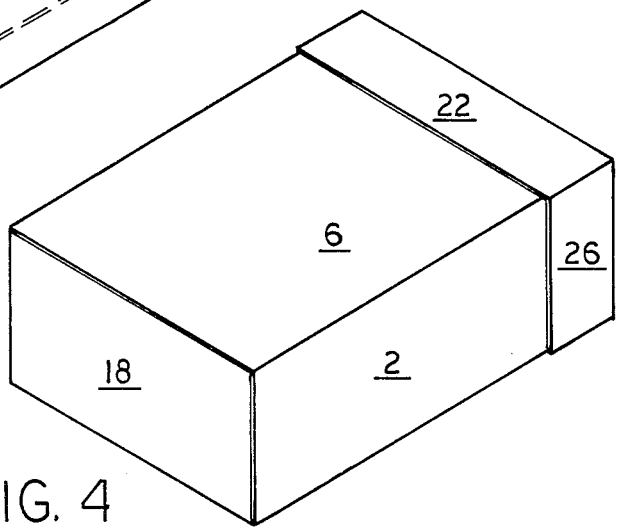

FIG. 4 is a perspective view of the completely assembled and sealed carton.

Figure 5:
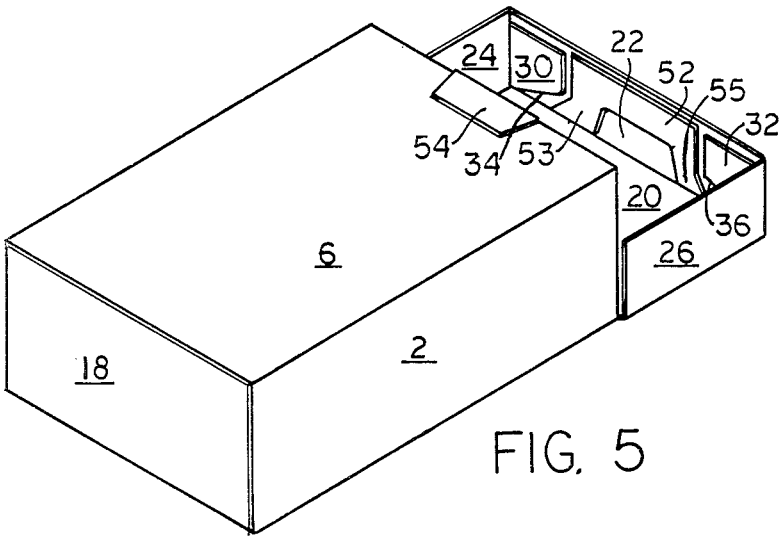

FIG. 5 is a perspective view of the carton after the hooded cover has been opened.

According to the invention, a carton is provided which may be formed from a integral blank. The carton has a bottom, front, rear, and side panels, and a hooded cover. Lock flaps are provided at the upper edge of the front wall panel and on the inner surface of the cover front wall panel, said flaps cooperating to retain the cover in closed position until it has been opened and, after opening, for reclosure. In the blank form the cover is detachably connected to the upper edge of the front wall panel by means of detachable webs of particular configuration. These webs cooperate with the lock flap member which is hingedly connected to the upper edge of the front wall panel. During assembly, the detachable webs, which are of unitary construction, become adhesively affixed to the cover assembly on the inner surface of the front wall thereof and, before severance of the webs from the upper edge of the carton front wall panel, serve to retain the cover in sealed position. The seal may be readily broken by lifting the cover and detaching it at the severance lines at which the carton front wall panel is connected at its upper edge to the webs. When the cover is reclosed, the cooperating lock flap located at the upper edge of the carton front wall serves to retain the cover in closed position by means of having its free edge in substantially abutting mutual engagement with the surrounding edges of the complementary unitary web, but said edges being free of attachment to each other, whereby said lock flap and said unitary web cooperate to retain said cover in closed position. The cover may of course be opened by applying sufficient force to overcome the locking retention afforded by the substantially abutting mutual engagement between the one lock flap and the complementary web of the other lock flap.

SPECIFIC REFERENCE TO THE DRAWINGS

Reference is now made to the accompanying drawings for a better understanding of the invention, wherein all the parts are numbered and wherein the same numbers are used to refer to corresponding parts thereof, and wherein areas which have or will have an adhesive applied thereto are indicated by stippled shading.

In a preferred form, the carton of the invention may be constructed from an integral blank, as illustrated in FIG. 1, the carton blank of FIG. 1 generally being shown at 1 and the novel hooded cover locking means according to the invention being generally shown at 50. The blank comprises side panels 2 and 4, front and rear panels 6 and 8 respectively, and a bottom 18 hingedly connected to the lower edge of rear panel 8 along crease score 25. Bottom tuck flaps 12 and 14 are respectively articulated to the lower edges of side wall panels 2 and 4 along crease scores 19 and 23, whereas bottom-forming flap 16 is articulated to the lower edge of front panel 6 along crease score 21. The main carton forming panels are articulated to each other along crease scores 11, 13, and 15, and glue flap 10 is articulated to rear panel 8 at one side edge thereof along crease score 17. It will be apparent that the glue flap 10 could equally well be articulated to one side edge of side wall panel 2.

Cover top panel 20 is articulated to the upper edge of rear panel 8 along crease score 27, and in turn has articulated thereto cover front wall 22 along crease score 33 and cover side panels 24 and 26, at each side thereof, respectively along crease scores 29 and 31. These cover side panels, in turn, have glue flaps 30 and 32 respectively articulated to their upper edges along crease scores 35 and 37. As shown, these cover side panel glue flaps have receding lower edges 34 and 36. The areas which will receive adhesive during the process of sealing the blank into a closed carton are shown on cover front panel 22 as areas 22A and on bottom 18 as area 18A. Glue flap 10 is adapted to receive adhesive on the reverse side thereof during the process of erecting and closing the carton.

Articulated to the upper edge of carton front wall panel 6 is the unique lock and reclosure means according to the present invention. Located centrally is lock flap 54, which may be and preferably is articulated to carton front panel 6 along a line of weakness such as a crease score 61, which may also and preferably does comprise a partial cut or cut score 61A. The edges of this lock flap 54 are free of attachment to the surrounding edges of complementary lock flap 52 because of cut 51, which defines the area of substantially abutting mutual engagement between lock flap 54 and complementary lock flap 52. As shown, the complementary lock flap 52 comprises a central portion and legs or webs 53 and 55 extending outwardly therefrom for surrounding the free edges of lock flap 54, said legs or webs thereof being articulated to the upper edge of carton front panel 6 by lines of severance such as perforations 57 and 59.

As shown, the lock flaps are 54 and 52, the latter including a central portion and integral webs 53 and 55 and these lock flaps 52 and 54 are as shown in abutting mutual engagement in the blank along cut 51. As shown, the cut is complete to provide smooth abutting edges for lock flaps 54 and 52, thereby permitting these lock flaps to swing independently of each other and to engage each other smoothly to provide a lock of maximum effectiveness when in place in the erected and sealed or opened and reclosed carton.

In erecting the carton from the blank, an adhesive is first applied to the outside of glue flap 10, that is, on the side opposite that shown in the view of FIG. 1. Glue flap 10 is first folded inwardly upon carton rear panel 8, adhesive applied thereto, and then the blank folded over along crease score 13 so as to bring the inner surface of the outer edge of side panel 2 into juxtaposition and then overlapping relation with glue flap 10. The carton is at this point side seamed and in the form of a flat-folded tube, and may be so shipped to the packager, sealed only along the proverbial manufacturer's glue seam.

To further assemble the carton for filling, the folded carton may be squared up by any suitable means, such as a conventional squaring machine. As so squared up, the carton, now in the form of an erected open tube, is shown in FIG. 2, with all other elements in the same positions as in the blank 1 as shown in FIG. 1.

For closing of the carton, the contents, which may advantageously take the form of envelopes, packs, packages, or inner wraps, are first placed inside the receptacle formed by the tube comprising the various carton panels, glue applied to bottom 18 in the area indicated at 18A, tuck flaps 12 and 14 turned inwardly beneath bottom-forming flap 16, and bottom 18 adhered to the other bottom-forming members by the adhesive applied in area 18A. Simultaneously or subsequently, adhesive is applied to areas 22A on cover front panel 22, this application of course being made on the interior surface thereof, cover side panels 24 and 26 are folded inwardly, into an essentially vertical position, end flaps 30 and 32 are likewise folded inwardly into an essentially vertical position, and cover front panel 22 is then folded down against and maintained in contact with end flaps 30 and 32, thereby completing the hooded cover structure.

Simultaneously with or subsequent to formation of the hooded cover structure, the cover is closed upon the carton front panel 6, thereby sandwiching lock members 52 and 54 between carton front face 6, against which these elements 52 and 54 have previously been folded, and the inner surface of cover front panel 22. Folding over of this cover front panel 22 against lock flap 52 adhesively secures lock flap 52 to the inner surface of cover front panel 22, and the carton is then and thereafter in sealed condition as shown in FIG. 4. In this condition, lock flaps 52 and 54 are folded over and in juxtaposition with the outer surface of front wall panel 6, with lock flap 52 adhesively affixed to the inner surface of cover front wall panel 22.

To open the carton, a lower edge of the carton front panel 22 may be lifted, causing severance of the webs or legs 53,55 of lock flap 52 from the upper edge of carton front panel 6 at severance lines 57 and 59, here shown as perforations, thereby breaking the seal and freeing the cover so that it may be opened. The one lock flap 52, comprising the complementary integral webs 53 and 55, remains adhesively affixed to the inner surface of cover front panel 22, rendering that panel more rigid, as shown in FIG. 5. cover side panel glue flaps 30 and 32, due to their recessed edges 34 and 36, remain adhered to the inner surface of cover front panel 22, but out of the way of web members 53,55 of second lock member 52. Lock member 54 remains articulated along its one edge to the upper edge of carton front panel 6. When the cover is reclosed, the free edges of lock flap 54 abuttingly engage the surrounding free edges of lock flap 52, comprising its central body portion and divergent webs 53 and 55, along the circumferential cut 51, thereby retaining the cover in closed position and preventing its opening even when accidentally dropped. The carton after reclosure is the same as shown in FIG. 4. The cover may be reopened simply by applying sufficient upward force upon cover front wall 22 to spring or pivot lock flap 54, which is not adhesively affixed to carton front panel 6, but to which it is merely hingedly connected, thereby causing it to become outwardly extended, possibly also causing the edge of carton front wall panel 6 to be bent slightly inwardly, and in any event to permit release of the edges of lock flap 54 from the inner peripheral substantially abutting mutual engagement with the corresponding surrounding edges of lock flap 52. The cover may be subsequently closed and reopened many times without losing the effectiveness of the lock structure according to the present invention. In an alternative embodiment (not shown), the adhesive 22A applied centrally of the interior surface of the carton cover front panel 22 may instead be applied to the inner (upwardly-exposed) surface of lock flap 52, but this represents no particular advantage inasmuch as all necessary adhesive can be applied to the interior surface of cover front panel 22 in a single sweep.

The adhesive employed in the specified glue areas for sealing the cartons of the present invention may be of any suitable or conventional type. For example, ordinary glue may be employed, conventional hot-melt adhesives may be employed or, in a non-preferred embodiment, the adhesive may be pre-applied and heat-activatable by application of heated mandrels or plates during the sealing operation. However, for effecting the side-sealing at the manufacturer's joint, as well as for securing the bottom-forming members and the cover-forming members, ordinary glue or hot melt is entirely satisfactory and is accordingly preferred.

It is to be understood that the invention is not limited to the exact details of construction, operation, or exact materials or embodiments shown and described, as obvious modifications and equivalents will be apparent to one skilled in the art, and the invention is therefore to be limited only by the scope of the appended claims.

I claim:

1. A carton formed of an integral blank comprising a container assembly including a front wall panel, a rear wall panel, and side wall panels, and a cover assembly hingedly connected to said rear wall panel including a cover top panel having a cover front wall panel and cover end wall panels connected thereto, and first and second lock flaps positioned between said cover front wall panel and said front wall panel, said first lock flap being affixed to the inner surface of said cover front wall panel and said second lock flap being hingedly connected to the upper edge of and folded over into juxtaposition with the outer surface of said front wall panel, said second lock flap being articulated to the upper edge of said front wall panel and being located centrally thereof, said first lock flap comprising a central body portion and webs outwardly disposed with respect to said second lock flap, said first lock flap surrounding said second lock flap and the said webs of said first lock flap being detachably connected by lines of severance to the upper edge of said front wall panel at their ends, the edges of said second lock flap being surrounded by and in substantially abutting mutual engagement with but free of attachment to the corresponding edges of said first lock flap on all sides of said second lock flap except the side hingedly connected to the upper edge of said front wall panel whereby, upon opening and reclosing of said carton, said lock flaps cooperate to retain said cover in closed position by substantially abutting mutual engagement of the surrounding edges of said first lock flap with the corresponding free edges of said second lock flap.

2. An end closure for a carton having a container portion closed at its lower end and comprising front, rear, and side wall panels, said end closure including a cover assembly hingedly connected to said rear wall panel including a cover top panel having a cover front wall panel and cover end wall panels connected thereto, and first and second lock flaps positioned between said cover front wall panel and said front wall panel, said first lock flap being affixed to the inner surface of said cover front wall panel and said second lock flap being hingedly connected to the upper edge of and folded over into juxtaposition with the outer surface of said front wall panel, said second lock flap being articulated to the upper edge of said front wall panel and being located centrally thereof, said first lock flap comprising a central body portion and webs outwardly disposed with respect to said second lock flap, said first lock flap surrounding said second lock flap and the said webs of said first lock flap being detachably connected by lines of severance to the upper edge of said front wall panel at their ends, the edges of said second lock flap being surrounded by and in substantially abutting mutual engagement with but free of attachment to the corresponding edges of said first lock flap on all sides of said second lock flap except the side hingedly connected to the upper edge of said front wall panel whereby, upon opening and reclosing of said carton, said end closure retains said cover in closed position by substantially abutting mutual engagement of the surrounding edges of said first lock flap with the corresponding edges of said second lock flap along free edges thereof.

3. An integral blank for forming a carton comprising a front wall panel, a rear wall panel, and side wall panels, and a cover assembly hingedly connected to said rear wall panel including a cover top panel having a cover front wall panel and cover end wall panels connected thereto, and first and second lock flaps adapted to be positioned between said cover front wall panel and said front wall panel in a carton erected from said blank, said first lock flap being adapted to be affixed to the inner surface of said cover front wall panel in the erected carton and said second lock flap being adapted to be folded over into juxtaposition with the outer surface of said front wall panel, said second lock flap being articulated to the upper edge of said front wall panel and being located centrally thereof, said first lock flap comprising a central body portion and webs outwardly disposed with respect to said second lock flap, said first lock flap surrounding said second lock flap and the said webs of said first lock flap being detachably connected by lines of severance to the upper edge of said front wall panel, the edges of said second lock flap being surrounded by and in substantially abutting mutual engagement with but free of attachment to the corresponding edges of said first lock flap on all sides of said second lock flap except the side hingedly connected to the upper edge of said front wall panel whereby, upon erection of a carton from said blank and upon opening and reclosing of said carton, said lock flaps cooperate to retain said cover in closed position by substantially abutting mutual engagement of the surrounding edges of said first lock flap with the corresponding free edges of said second lock flap.

4. An integral carton blank of claim 3 wherein the ends of said webs of said first lock flap are detachably connected to the upper edge of said front face panel by perforations.

5. An integral blank of claim 3, comprising a glue flap hinged along a side edge of one of said rear wall panel and a side wall panel, side seamed by having the other of said panels adhered to said glue flap, folded over upon itself in the form of a flat-folded tube.

6. An integral blank of claim 3, comprising a glue flap hinged along a side edge of one of said rear wall panels and a side wall panel, side seamed by having the other of said panels adhered to said glue flap, in the form of an open sleeve or tube.

* * * * *